US006991324B2

(12) United States Patent
Watase et al.

(10) Patent No.: US 6,991,324 B2
(45) Date of Patent: Jan. 31, 2006

(54) SOLUTION INJECTOR HEAD, FUNCTIONAL LAYER FORMING APPARATUS AND LIQUID CRYSTAL DISPLAY

(75) Inventors: Naoki Watase, Kashiwa (JP); Hironori Toyoshima, Nagareyama (JP); Tsuneyoshi Shimizu, Ryugasaki (JP); Makoto Nakahara, Nara (JP); Daisuke Ikesugi, Joyo (JP); Takatoshi Kira, Taharamoto (JP); Yoshihisa Ohta, Yokkaichi (JP)

(73) Assignees: Sharp Kabushiki Kaisha, Osaka (JP); Hitachi Industries Co., Ltd., Tokyo (JP); JSR Corporation, Tokyo (JP)

( * ) Notice: Subject to any disclaimer, the term of this patent is extended or adjusted under 35 U.S.C. 154(b) by 139 days.

(21) Appl. No.: 10/386,557

(22) Filed: Mar. 13, 2003

(65) Prior Publication Data

US 2003/0210303 A1 Nov. 13, 2003

(30) Foreign Application Priority Data

Mar. 19, 2002 (JP) ..... 2002-076014

(51) Int. Cl.
*B41J 2/045* (2006.01)

(52) U.S. Cl. ..... 347/68

(58) Field of Classification Search ..... 347/68–72; 264/446, 447, 104, 105; 29/25.35, 890.1
See application file for complete search history.

(56) References Cited

U.S. PATENT DOCUMENTS 6,432,348 B1 * 8/2002 Yamanaka ..... 264/446

FOREIGN PATENT DOCUMENTS

| | | |
|---|---|---|
| JP | A-54-21862 | 2/1979 |
| JP | A-63-106727 | 5/1988 |
| JP | 63265647 A | * 11/1988 |
| JP | 06-297699 | 10/1991 |
| JP | A-6-332976 | 8/1994 |
| JP | A-9-166783 | 6/1997 |

* cited by examiner

*Primary Examiner*—Stephen Meier
*Assistant Examiner*—An H. Do
(74) *Attorney, Agent, or Firm*—Antonelli, Terry, Stout and Kraus, LLP.

(57) ABSTRACT

In a solution emitting head for emitting a solution through an outlet, having a main body including a cavity, a cover attached to the main body in such a manner that the cover covers the cavity to form a chamber so that the solution is stored in the chamber temporarily before being emitted from the outlet, and a solution pressurizing device for pressurizing the solution in the chamber, the cover is fixedly attached to the main body by one of metal-to-metal bonding and an adhesive dissolution-resistant against the solution between the cover and the main body.

5 Claims, 9 Drawing Sheets

FIG. 8

| ORIENTED LAYER CONDITION | |
|---|---|
| ①MATERIAL | POLYAMIC ACID ORIENTED LAYER SUPPLIED BY JSR INC. |
| ②CONCENTRATION OF SOLID COMPONENT IN ORIENTED LAYER | 2.0%, 2.3% |

| FORMING CONDITION | |
|---|---|
| ①PIEZOELECTRIC ELEMENT OPERATING FREQUENCY | 281Hz |
| ②PIEZOELECTRIC ELEMENT ENEGIZING VOLTAGE | 32V |
| ③DISTANCE BETWEEN OUTLETS | 330μm |
| ④STAGE SPEED | 120mm/s |

| CONCENTRATION OF SOLID COMPONENT IN ORIENTED LAYER MATERIAL / CONDITION | 2.0% | | 2.3% | | FLEXOGRAPHIC PRINTING | |
|---|---|---|---|---|---|---|
| SUBSTRATE | SEG | COM | SEG | COM | SEG | COM |
| COATING UNEVENNESS | NONE | NONE | NONE | NONE | NONE | NONE |
| LAYER THICKNESS (Å) | 450 | 400 | 510 | 440 | 550 | 470 |
| DIFFERENCE IN PHASE (nm) | 1.00 | 1.05 | 1.15 | 1.45 | 1.10 | 1.40 |
| CELL CONDITION | | | | | | |
| LIGHTING UNEVENNESS | NONE | | NONE | | NONE | |
| ORIGINAL VOLTAGE KEEPING RATE (%) | 72.0 | | 73.0 | | 70.0 | |
| KEEPING RATE AFTER 60°C ELECTRICAL ENERGIZATION | 78.0 | | 82.0 | | 76.0 | |
| KEEPING RATE AFTER STORAGE IN 60°C ENVIRONMENT | 68.0 | | 69.5 | | 65.0 | |
| ORIGINAL IDC (mV) | 7.83 | | 7.10 | | 8.95 | |
| IDC AFTER ELECTRICAL ENERGIZATION(mV) | 7.47 | | 6.75 | | 8.03 | |
| IDC AFTER STORAGE IN 60°C ENVIRONMENT | 8.00 | | 7.33 | | 9.10 | |
| PRE-TILT ANGLE | 3.5 | | 3.6 | | 3.6 | |
| α VALUE | 1.037 | | 1.038 | | 1.039 | |
| Co RATIO | 31 | | 30 | | 28 | |
| $\tau r+\tau d$ | 123 | | 123 | | 118 | |

FIG. 9

| INSULATING LAYER CONDITION | |
|---|---|
| CONCENTRATION OF SOLID COMPONENT IN INSULATING LAYER MATERIAL | 1.3% |

| FORMING CONDITION | |
|---|---|
| ①PIEZOELECTRIC ELEMENT OPERATING FREQUENCY | 281Hz |
| ②PIEZOELECTRIC ELEMENT ENERGIZING VOLTAGE | 32V |
| ③DISTANCE BETWEEN OUTLETS | 330μm |
| ④STAGE SPEED | 40mm/s |

| CONDITION | CONCENTRATION OF SOLID COMPONENT IN ORIENTED LAYER MATERIAL | FLEXOGRAPHIC PRINTING |
|---|---|---|
| SUBSTRATE | SEG | SEG |
| COATING UNEVENNESS | NONE | NONE |
| LAYER THICKNESS (Å) | 650 | 650 |
| CELL CONDITION | | |
| LIGHTING UNEVENNESS | NONE | NONE |

SOLUTION INJECTOR HEAD, FUNCTIONAL LAYER FORMING APPARATUS AND LIQUID CRYSTAL DISPLAY

BACKGROUND OF THE INVENTION

The present invention relates to a solution emitting head (particularly preferable for forming a functional layer (such as an oriented layer, an insulating layer or the like) of a liquid crystal display), a functional layer forming apparatus and a liquid crystal display.

JP-A-6-238876 discloses a flexographic printing in which a solution as a material of a functional layer, for example, an oriented layer, an insulating layer or the like is formed on a substrate, comprising, an anilox roll having an outer peripheral metallic surface forming fine recesses surface pattern, a doctor roll having a synthetic resin outer peripheral surface, a relief printing plate of synthetic resin, a printing drum for holding the relief printing plate on an outer periphery thereof, a supply nozzle for supplying the solution to the outer peripheral metallic surface of the anilox roll, and a movable table for holding the substrate thereon, wherein the solution on the outer peripheral metallic surface of the rotating anilox roll is pressed by the synthetic resin outer peripheral surface of the rotating doctor roll to be spread over the outer peripheral metallic surface of the anilox roll so that a thin layer of the solution is formed, subsequently the thin layer of the solution is transferred from the outer peripheral metallic surface of the anilox roll onto the relief printing plate on the outer periphery of the rotating printing drum, and finally the thin layer of the solution is transferred from the rotating relief printing plate onto the moving substrate.

JP-A-54-21862 and JP-A-63-106727 discloses that the solution is directly supplied onto the substrate to form the thin layer thereof on the substrate.

JP-A-9-166783 discloses an emitting head for emitting the solution onto the substrate to form the thin layer thereof on the substrate.

BRIEF SUMMARY OF THE INVENTION

An object of the present invention is to provide a solution emitting head (usable as an inkjet head), a functional layer forming apparatus with the solution emitting head and a liquid crystal display manufactured by the functional layer forming apparatus, in which solution emitting head an inner surface of the solution emitting head is prevented from being deteriorated by a solution.

According to the present invention, in a solution emitting head for emitting a solution through an outlet, having, a main body including a cavity, a cover attached to the main body in such a manner that the cover covers the cavity to form a chamber so that the solution is stored in the chamber temporarily before being emitted from the outlet, and a solution pressurizing device for pressurizing the solution in the chamber to be discharged through the outlet from the chamber, the cover is fixedly attached to the main body by one of metal-to-metal (not including non-metallic member between the main body and the cover) bonding and an adhesive dissolution-resistant against the solution between the cover and the main body.

Since the cover is fixedly attached to the main body by one of metal-to-metal (not including non-metallic member between the main body and the cover) bonding and an adhesive dissolution-resistant against the solution between the cover and the main body, an inner surface of the solution emitting head is prevented from being deteriorated by the solution.

It is preferable for securely preventing the inner surface of the solution emitting head from being deteriorated by the solution that both the cover and the main body are metallic, and the metal-to-metal bonding is one of welding and diffusion-bonding between the cover and the main body, or that a main component or the whole of the adhesive after being cured is polyimide, preferably, thermoplastic polyimide obtainable after polyimide as the adhesive or soluble polyimide as an antecedent of the polyimide is treated thermally or baked-and-cooled to be completely cured or polymerized without solvent therein. In this case, it is preferable for simplifying a structure of the emitting head that a main component of one of the cover and the main body is thermoplastic polyimide, and a part of the one of the cover and the main body facing to another one of the cover and the main body as the adhesive adheres to the another one of the cover and the main body as the adhesive. The diffusion-bonding between the cover and the main body with heating them for mutual diffusion therebetween and pressing them against each other to increase a contact area therebetween may be a diffusion-bonding in which the diffusion proceeds until a boundary between the cover and the main body becomes invisible or unmeasurable so that the bonding strength therebetween is significantly high, or a diffusion-bonding with a sufficient bonding strength therebetween in which diffusion-bonding the boundary between the cover and the main body is visible or measurable, that is, the diffusion is prevented from proceeding until the boundary between the cover and the main body becomes invisible or unmeasurable.

A part of the cover facing to the chamber may be deformable as a part of the solution pressurizing device in such a manner that a volume of the chamber is decreased to pressurize the solution in the chamber. The solution pressurizing device may include a piezoelectric element for urging the part of the cover to pressurize the solution in the chamber. The solution pressurizing device may be a heater for heating the solution to be pressurized in the chamber with vaporization of the solution.

When the solution includes a polar solvent, it is necessary for the adhesive to be dissolution-resistant against the polar solvent. When the solution includes at least one of soluble polyimide and poly-amic-acid as a material of a layer to be formed on a substrate of a liquid crystal display, and a polar solvent for solving the at least one of soluble polyimide and poly-amic-acid, and the polar solvent includes at least one of N-methyl-pyrrolidone, γ-butyrolactone and N-dimethylformamide, it is preferable for securely preventing the inner surface of the solution emitting head from being deteriorated by the solution that both the cover and the main body are metallic, and the metal-to-metal bonding is one of welding and diffusion-bonding between the cover and the main body, or that a main component or the whole of the adhesive after being cured is polyimide, preferably, thermoplastic polyimide obtainable after polyimide as the adhesive or soluble polyimide as an antecedent of the polyimide is treated thermally or baked-and-cooled to be completely cured or polymerized without solvent therein.

An apparatus for forming a functional layer by emitting a solution as a material of the functional layer onto a substrate, comprises, a solution emitting head for emitting the solution through an outlet of the solution emitting head, including, a main body including a cavity, a cover attached to the main body in such a manner that the cover covers the cavity to form a chamber so that the solution is stored in the chamber temporarily before being emitted from the outlet, and a solution pressurizing device for pressurizing the solution in the chamber, wherein the cover is fixedly attached to the main body by one of metal-to-metal bonding and an adhesive dissolution-resistant against the solution between the cover and the main body, and a table adapted to hold the substrate thereon and movable with respect to the solution emitting head while the solution emitting head emits the solution onto the substrate so that the solution is distributed on the substrate to form the functional layer.

In a liquid crystal display comprising, a pair of base plates, each of which base plates includes a substrate, a transparent electrode and an oriented layer, a spacer through which the base plates are spaced apart from each other while the oriented layers of the base plates face to each other, a sealing member extending between the base plates to form a closed space between the base plates, and a liquid crystal contained in the closed space, the oriented layer is formed by an apparatus with emitting a solution as a material of the oriented layer onto the substrate, comprising, a solution emitting head for emitting the solution through an outlet of the solution emitting head, including, a main body including a cavity, a cover attached to the main body in such a manner that the cover covers the cavity to form a chamber so that the solution is stored in the chamber temporarily before being emitted from the outlet, and a solution pressurizing device for pressurizing the solution in the chamber, wherein the cover is fixedly attached to the main body by one of metal-to-metal bonding and an adhesive dissolution-resistant against the solution between the cover and the main body, and a table adapted to hold the substrate thereon and movable with respect to the solution emitting head while the solution emitting head emits the solution onto the substrate so that the solution is distributed on the substrate to form the oriented layer.

A method for forming a liquid crystal display by an apparatus for forming a layer by emitting a solution as a material of the layer onto a substrate, comprising, a solution emitting head for emitting the solution through an outlet of the solution emitting head, including, a main body including a cavity, a cover attached to the main body in such a manner that the cover covers the cavity to form a chamber so that the solution is stored in the chamber temporarily before being emitted from the outlet, and a solution pressurizing device for pressurizing the solution in the chamber, wherein the cover is fixedly attached to the main body by one of metal-to-metal bonding and an adhesive dissolution-resistant against the solution between the cover and the main body, and a table adapted to hold the substrate thereon and movable with respect to the solution emitting head while the solution emitting head emits the solution onto the substrate so that the solution is distributed on the substrate to form the functional layer, comprising the steps of:

emitting a first solution as a material of an insulating layer onto the substrate from the apparatus to form a film of the first solution on the substrate, drying the film of the first solution to remove a polar solvent of the first solution from the first solution so that the insulating layer is formed, emitting a second solution as a material of an oriented layer onto the substrate from the apparatus to form a film of the second solution on the substrate, drying the film of the second solution to remove a polar solvent of the second solution from the second solution so that the oriented layer is formed, and baking the insulating layer and oriented layer on the substrate.

Other objects, features and advantages of the invention will become apparent from the following description of the embodiments of the invention taken in conjunction with the accompanying drawings.

BRIEF DESCRIPTION OF THE SEVERAL VIEWS OF THE DRAWINGS

FIG. 8 includes tables showing experimental results of oriented layers formed by the solution emitting head of the invention.

FIG. 9 includes tables showing experimental results of an insulating layer formed by the solution emitting head of the invention.

DETAILED DESCRIPTION OF THE INVENTION

Figure 1:
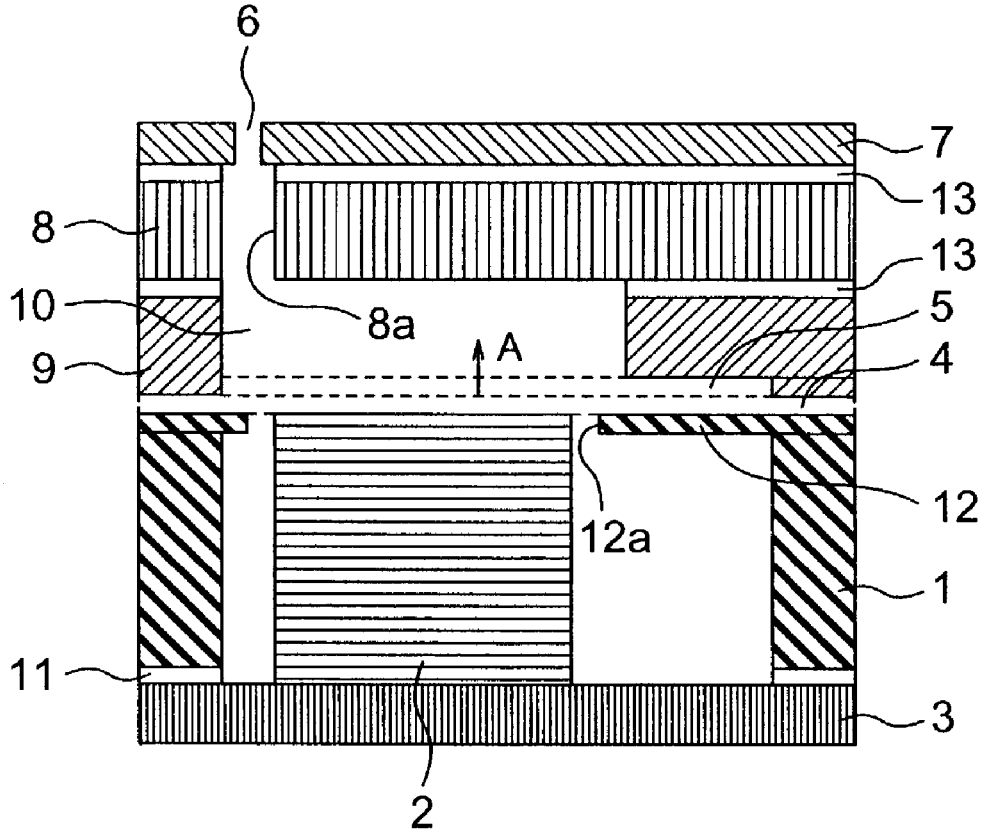
FIG. 1 is a cross-sectional view showing a solution emitting head of the invention.

As shown in FIG. 1, a solution emitting head has a main body 1, a piezoelectric element 2, a base plate 3 adheres to the main body 1 through an adhesive 11 of, for example, epoxy resin, a deformable pressurizing member 4, a solution inlet 5, a solution outlet 6, an outlet plate 7, a cavity cover 8 adhered to the outlet plate 7 through a joint 13 of the invention and including a through hole 8*a,* an inlet plate 9 adhered to the cavity cover 8 through the joint 13 of the invention and including a cavity 10, and a support plate 12 of stainless steel including an opening 12*a*.

The pressurizing member 4 is a polyimide film (of, for example, Yuhpilex VT supplied from Ube-Kousan Inc.,) adhered to the support plate 12 and the inlet plate 9 by heating for about 20 minutes parts of the pressurizing member 4 facing to the support plate 12 and the inlet plate 9 to about 330° C. while compressing the pressurizing member 4 between the support plate 12 and the inlet plate 9 by 1.96 MPa, and subsequently cooling the parts of the pressurizing member 4 to be cured.

The piezoelectric element 2 mounted on the base plate 3 contacts the pressurizing member 4 at an end thereof through the opening 12*a*. The pressurizing member 4 contacts the support plate 12 to be supported thereon when the piezoelectric element 2 is not electrically energized, and is deformed by the piezoelectric element 2 to move away at least partially from the support plate 12 in a direction denoted by an arrow A so that a solution with which a solution chamber formed by the cavity 10, the cavity cover 8 and the pressurizing member 4 is filled is pressurized by a decrease in volume of the solution chamber to emit the solution through the through hole 8*a* from the solution outlet 6 when the piezoelectric element 2 is electrically energized to expand longitudinally.

The solution inlet 5 may include a valve (not shown) opened when the piezoelectric element 2 is not energized and closed when the piezoelectric element 2 is energized, and the solution outlet 6 may include a valve (not shown) opened when the piezoelectric element 2 is energized and closed when the piezoelectric element 2 is not energized. A plurality of the solution outlets 6 may fluidly communicate with the solution chamber.

Figure 2:
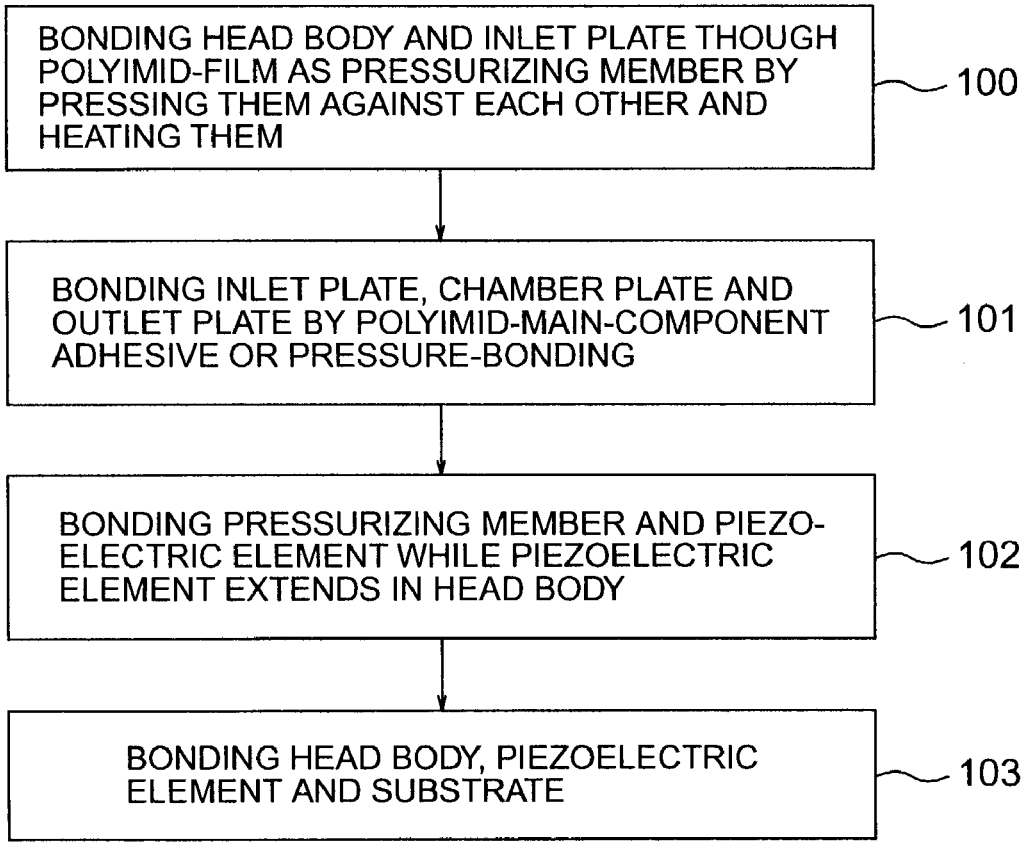
FIG. 2 is a flow chart showing a process for forming the solution emitting head.

The solution emitting head is made as shown in FIG. 2. In step 100, the pressurizing member 4 of polyimide film is adhered to the support plate 12 (previously bonded to the main body 1) and the inlet plate 9 by heating for about 20 minutes the parts of the pressurizing member 4 facing respectively to the support plate 12 and the inlet plate 9 to about 330° C. while compressing the pressurizing member 4 between the support plate 12 and the inlet plate 9 by 1.96 MPa. In other words, the pressurizing member 4 of polyimide film acts as an adhesive for bonding the support plate 12 and the inlet plate 9.

In step 101, the cavity cover 8 is bonded to the inlet plate 9 through a polyimide adhesive (at least one of the cavity cover 8 and the inlet plate 9 may be non-metallic or metallic), or through metal-to-metal (not including non-metallic element between the cavity cover 8 and the inlet plate 9) bonding, for example, welding or diffusion bonding only when both the cavity cover 8 and the inlet plate 9 are metallic, and the outlet plate 7 is bonded to the cavity cover 8 through a polyimide adhesive (at least one of the cavity cover 8 and the inlet plate 9 may be non-metallic or metallic), or through metal-to-metal (not including non-metallic element between the cavity cover 8 and the outlet plate 7) bonding, for example, welding or diffusion bonding only when both the cavity cover 8 and the outlet plate 7 are metallic. It is preferable for the outlet plate 7, the cavity cover 8 and the inlet plate 9 to be made of the same material or to be not significantly different in thermal expansion coefficient among them.

In step 102, the end of the piezoelectric element 2 is fixed to the pressurizing member 4 by an adhesive, for example, an epoxy resin adhesive or the polyimide adhesive. In step 103, the pressurizing member 4 and the main body 1 are adhered to the base plate 3 by an adhesive, for example, the epoxy resin adhesive or the polyimide adhesive.

Figure 3:
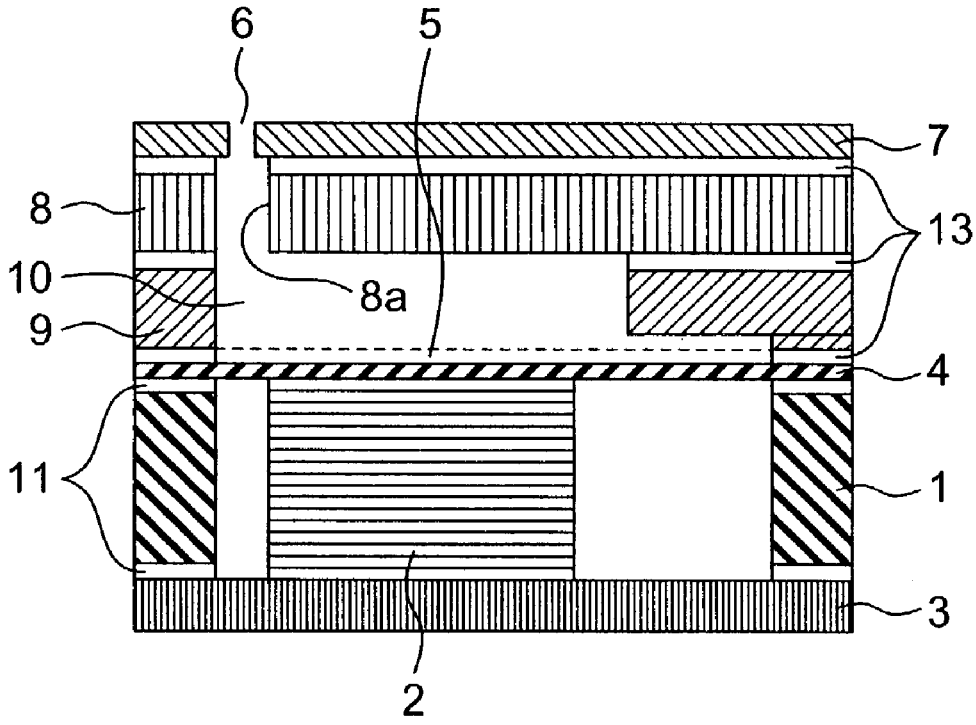
FIG. 3 is a cross-sectional view showing another solution emitting head of the invention.

In another embodiment as shown in FIG. 3, the pressurizing member 4 is a deformable stainless steel thin plate. In this case, since a rigidity of the stainless steel thin plate is larger than that of the polyimide film, the support plate 12 may be deleted. The pressurizing member 4 of stainless steel thin plate is adhered to the main body 1 through the epoxy resin adhesive or polyimide adhesive, and is adhered to the inlet plate 9 through the polyimide adhesive. The metallic pressurizing member 4 may be fixed to the metallic main body 1 and/or inlet plate 9 by the metal-to-metal bonding. The pressurizing member 4 may be formed by a sheet or film of another material (other than stainless steel or polyimide) dissolution-resistant against the solution.

As shown in FIGS. 8 and 9, oriented layers and insulating layers formed by the solutions emitted from the solution emitting head of the invention are not inferior to those formed by the solutions coated by the flexographic printing.

Figure 4:
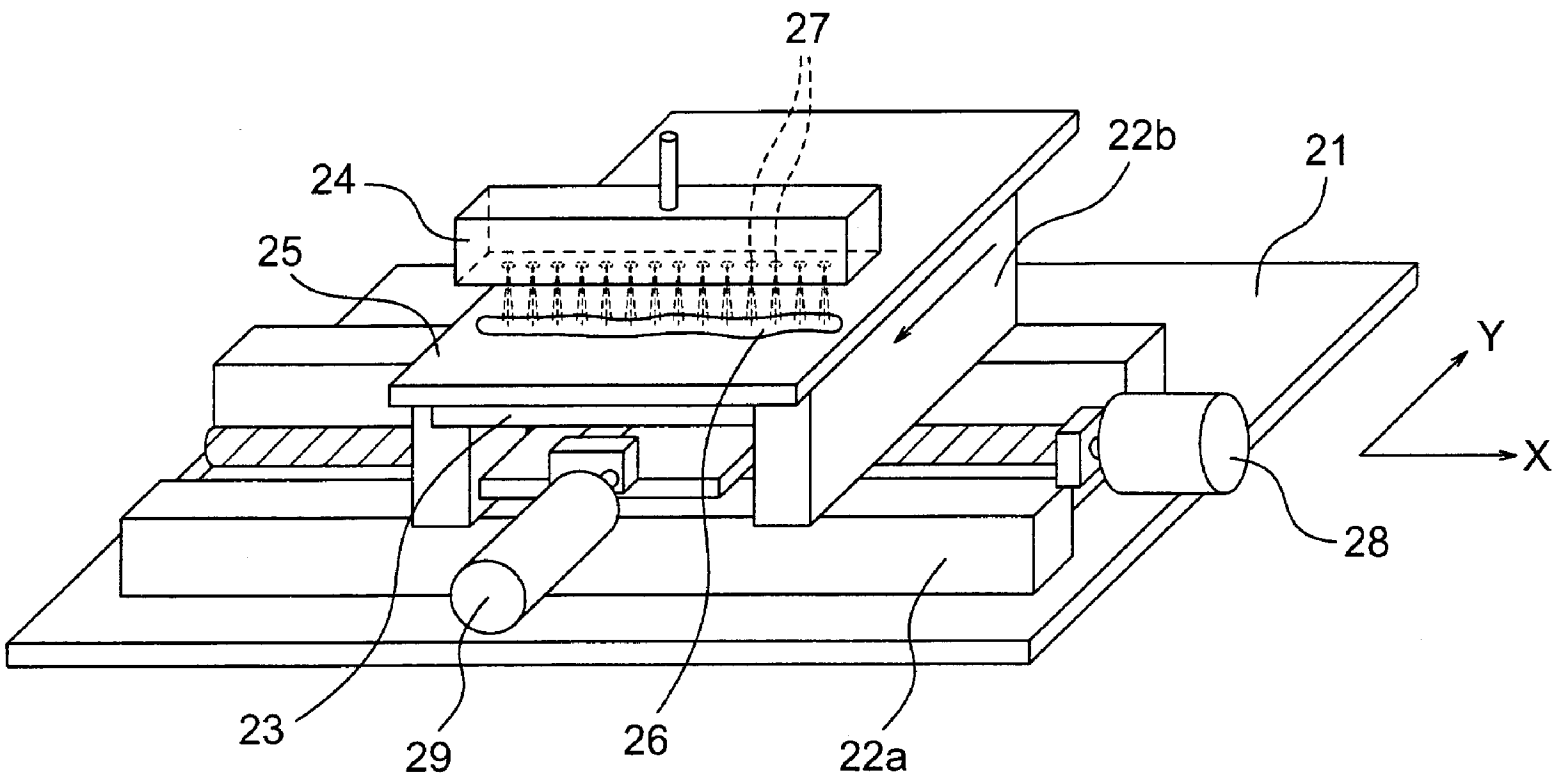
FIG. 4 is a schematic oblique projection view showing a functional layer forming apparatus with the solution emitting head of the invention.

As shown in FIG. 4, an apparatus for forming a functional layer such as the oriented layer or insulating layer by emitting the solution as the material of the functional layer onto the substrate, has a base plate 21, support members 22*a* and 22*b*, a movable table 23 for holding thereon a substrate 25 with vacuum suction therebetween, a solution emitting head 24 of the invention including solution emitting outlets 27 for emitting a solution 26, and X and Y axes drive motors 28 and 29. The support member 22*b* is guided along the support member 22*a*, and driven by the X axis drive motor 28 along the X axis. The movable table 23 is guided along the support member 22*b* and driven by the Y axis drive motor 29 along the Y axis.

Figure 5:
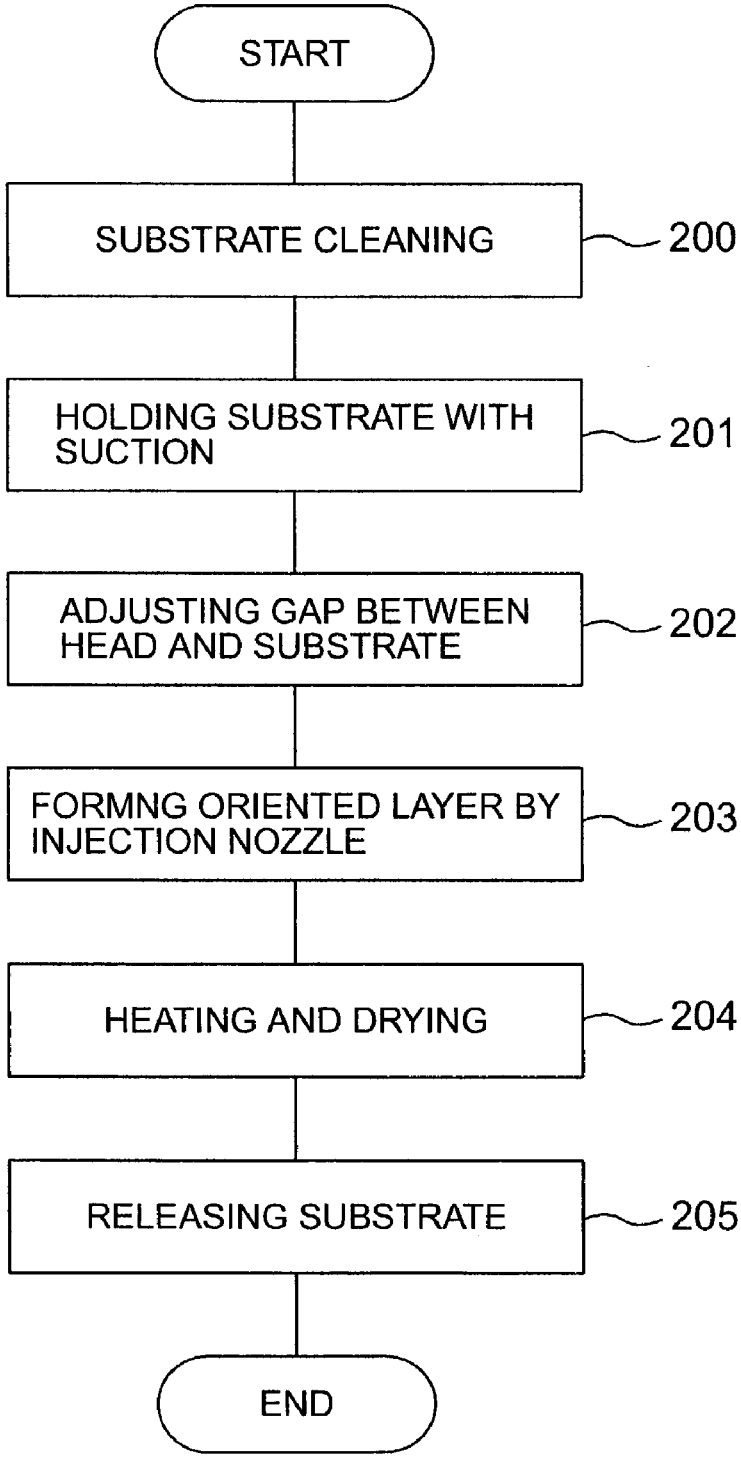
FIG. 5 is a flow chart showing a process for forming the functional layer forming apparatus.

In a functional layer forming process as shown in FIG. 5, firstly the substrate 25 is cleaned at step 200, at step 201 the substrate 25 is mounted onto the movable table 23 while the substrate 25 is pulled to a support plane of the movable table 23 with the vacuum suction so that a curvature of the substrate 25 is decreased to make the substrate 25 flat along the support plane, at step 202 a distance between the substrate 25 and the solution emitting outlets 27 is set at a desirable degree by moving the solution emitting head 24 vertically while the distance therebetween is measured by a laser focus shift meter (not shown), at step 203 the solution 26 (for example, 2.0–2.3 weight percent solution of JALS-9008 supplied from JSR Inc.,) is emitted from the solution emitting outlets 27 while generating relative movement between the substrate 25 and the solution emitting head 24 by the X and Y axes drive motors 28 and 29 so that the substrate 25 is coated with the solution 26, at step 204 the substrate 25 is moved to a heating and drying area so that a solvent, for example, N-methyl-pyrrolidone of the solution 26 is vaporized to be removed from the solution 26 by increasing a temperature of the substrate 25 gradually to about 50–70° C., and step 205 the substrate 25 is removed from the movable table 23 after completely drying the solution 26. Subsequently, the substrate 25 with the dried solution 26 is baked for more than 30 minutes in 250° C. environment to form an oriented layer from the dried solution 26.

A liquid crystal display including the functional layer formed by the solution emitting head of the invention as described above, as shown in FIG. 6, includes a lower substrate 30*a*, an upper substrate 30*b*, functional layers 31*a* and 31*b*, transparent electrodes 32*a* and 32*b*, an insulating layer 33, oriented layers 34*a* and 34*b*, a sealing element 36, a liquid crystal 37 and optical films 38*a* and 38*b*.

The functional layer 31*a* for operating under the transparent electrode of TFT element of TFT crystal liquid display, color filter of color crystal liquid display or black matrix is formed on the lower substrate 30*a*. The transparent electrode 32*a* is formed on the functional layer 31*a*, and the oriented layer 34*a* is formed on the transparent electrode 32*a* by the apparatus as shown in FIG. 4. The functional layer 31*b* is formed on the upper substrate 30*b*, and the transparent electrode 32*b* is formed on the functional layer 31*b*. The insulating layer 33 is formed on the transparent electrode 32*b* by the apparatus as shown in FIG. 4, and the oriented layer 34*b* is formed on the insulating layer 33 by the apparatus as shown in FIG. 4. Orienting operation are performed on the oriented layers 34*a* and 34*b*. The insulating layer 33 may be deleted.

The upper and lower substrates 30*a* and 30*b* with the layers as described above are connected by a spacer 36 and a sealant 35, and pressed against each other for a predetermined time period for curing the sealant 35 while keeping a positional relationship between the desirably. Subsequently, a liquid crystal is inserted between the upper and lower substrates 30*a* and 30*b*, and the optical films 38*a* and 38*b* are adhered to outer sides of the upper and lower substrates 30*a* and 30*b*.

As shown in FIGS. 8 and 9, the liquid crystal display formed by the solution emitting head of the invention or the apparatus of the invention as shown in FIG. 4 are not inferior to that formed by the flexographic printing.

Figure 6:
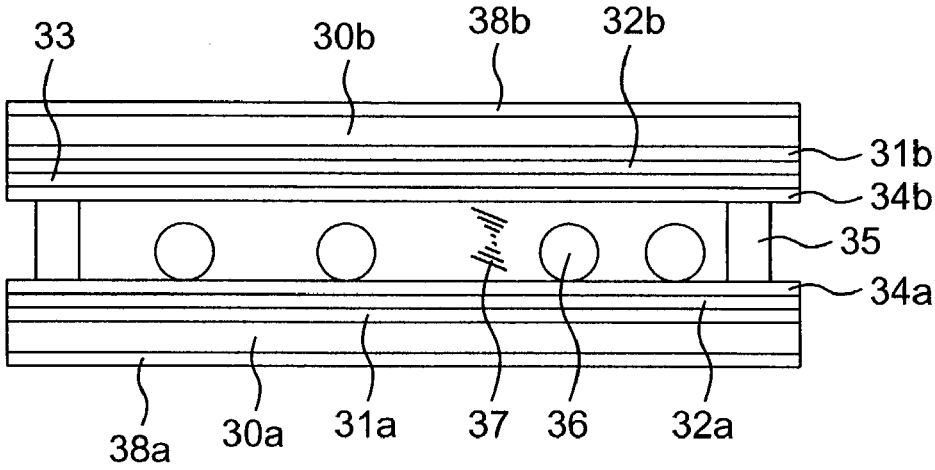
FIG. 6 is a schematic cross-sectional view showing a liquid crystal display.
Figure 7:
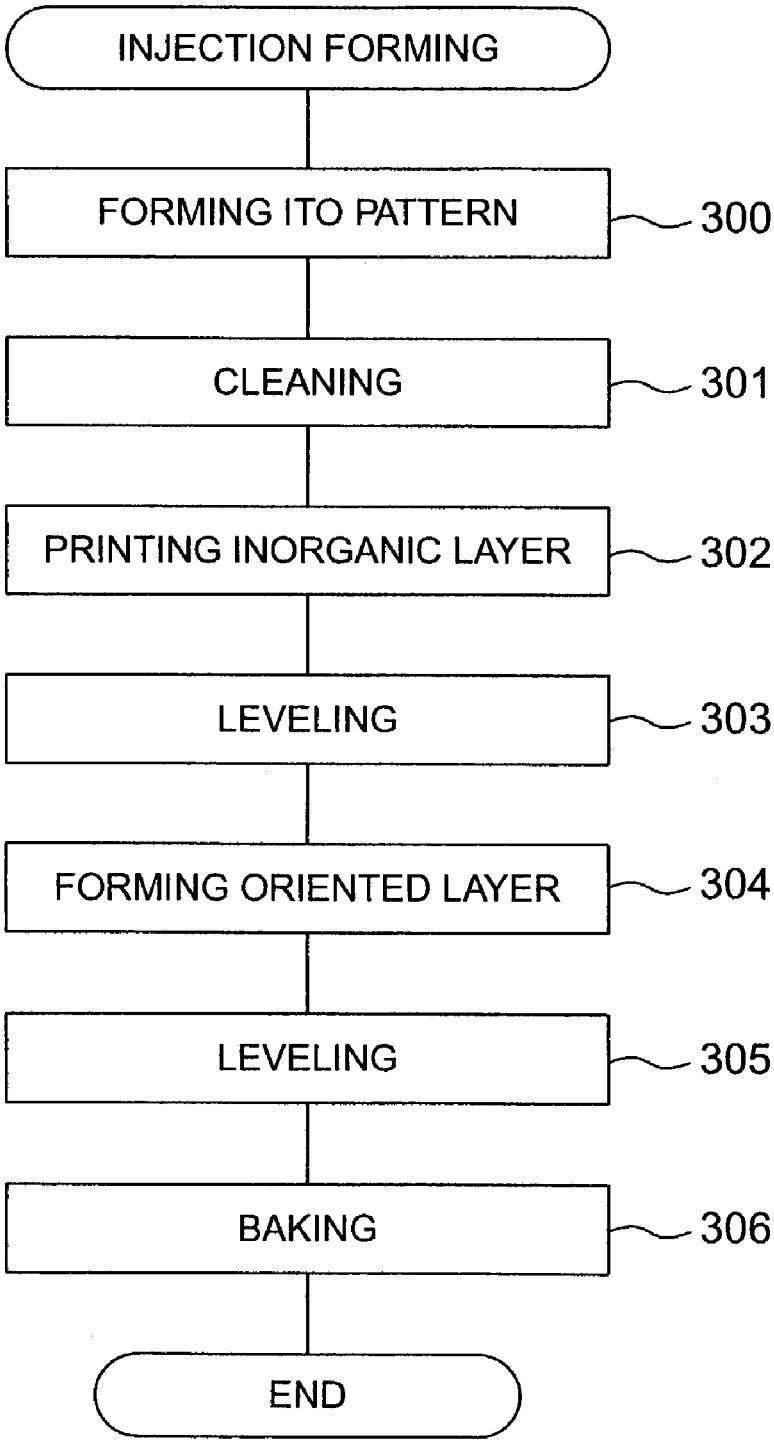
FIG. 7 is a flow chart showing a process for forming the functional layer forming apparatus.

The liquid crystal display as shown in FIG. 6 is formed by the apparatus as shown in FIG. 4 through a process as shown in FIG. 7. At step 300 an ITO layer is formed on the substrate, at step 301 the substrate with the ITO layer is cleaned, at step 302 an anorganic layer is formed on the substrate, at step 303 leveling operation is performed, at step 304 the oriented layer is formed on the substrate, at step 305 leveling operation is performed, and step 306 the substrate is baked. Therefore, according to the present invention, excessive baking and cleaning steps can be deleted in comparison with the flexographic printing.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A solution emitting head for emitting a solution through an outlet, comprising, a main body including a cavity, a cover attached to the main body in such a manner that the cover covers the cavity to form a chamber so that the solution is stored in the chamber temporarily before being emitted from the outlet, and a solution pressurizing device for pressurizing the solution in the chamber to be discharged through the outlet from the chamber, wherein the cover is fixedly attached to the main body by an adhesive dissolution-resistant against the solution between the cover and the main body, a main component of the cover is thermoplastic polyimide, and a part of the cover facing to the main body adheres as the adhesive to the main body, and another part of the cover facing to the chamber is deformable in such a manner that a volume of the chamber is decreased to pressurize the solution in the chamber.

2. A solution emitting head according to claim 1, wherein the solution pressurizing device includes a piezoelectric element for urging the part of the cover to pressurize the solution in the chamber.

3. A solution emitting head according to claim 1, wherein the solution includes a polar solvent, and the adhesive is dissolution-resistant against the polar solvent.

4. A solution emitting head according to claim 1, wherein the solution includes at least one of soluble polyimide and poly-amic-acid as a material of a layer to be formed on a substrate of a liquid crystal display, and a polar solvent for solving the at least one of soluble polyimide and poly-amic-acid, and the polar solvent includes at least one of N-methyl-pyrrolidone, γ-butyrolactone and N-dimethylformamide.

5. An apparatus for forming a functional layer by emitting a solution as a material of the functional layer onto a substrate, comprising, a solution emitting head for emitting the solution through an outlet of the solution emitting head, including, a main body including a cavity, a cover attached to the main body in such a manner that the cover covers the cavity to form a chamber so that the solution is stored in the chamber temporarily before being emitted from the outlet and a solution pressurizing device for pressurizing the solution in the chamber, wherein the cover is fixedly attached to the main body by an adhesive dissolution-resistant against the solution between the cover and the main body, a main component of the cover is thermoplastic polyimide, and a part of the cover facing to the main body adheres as the adhesive to the main body, and another part of the cover facing to the chamber is deformable in such a manner that a volume of the chamber is decreased to pressurize the solution in the chamber, and a table adapted to hold the substrate thereon and movable with respect to the solution emitting head while the solution emitting head emits the solution onto the substrate so that the solution is distributed on the substrate to form the functional layer.

* * * * *